United States Patent [19]

Möbius

[11] 4,333,506

[45] Jun. 8, 1982

[54] PENCIL SHARPENER

[76] Inventor: Werner Möbius, Hindenburgstrasse 77, 8520 Erlangen, Fed. Rep. of Germany

[21] Appl. No.: 56,523

[22] Filed: Jul. 11, 1979

Related U.S. Application Data

[63] Continuation of Ser. No. 935,976, Aug. 22, 1978, abandoned.

[30] Foreign Application Priority Data

Oct. 11, 1977 [DE] Fed. Rep. of Germany ... 7731410[U]

[51] Int. Cl.[3] ..... B43L 23/00

[52] U.S. Cl. ..... 145/3.1; 145/3.5

[58] Field of Search ..... 145/3.1, 3.2, 3.3, 3.31, 145/3.32, 3.4, 3.5, 3.6, 3.61, 3.7, 3.8, 3.9, 61 C, 61 R

[56] References Cited

U.S. PATENT DOCUMENTS

| | | | |
|---|---|---|---|
| 399,839 | 3/1889 | Codd | 145/3.1 |
| 896,100 | 8/1908 | Geraci | 145/3.3 |
| 1,204,959 | 11/1916 | Duncan | 145/3.5 |
| 1,887,422 | 11/1932 | Oulton | 145/3.61 |
| 4,210,185 | 7/1980 | Acevedo | 145/61 R |

FOREIGN PATENT DOCUMENTS

| | | | |
|---|---|---|---|
| 68657 | 2/1949 | Denmark | 145/3.5 |
| 1033094 | 6/1958 | Fed. Rep. of Germany | 145/3.2 |
| 974857 | 10/1950 | France | 145/3.5 |
| 2256005 | 7/1975 | France | 145/61 C |
| 130177 | 1/1929 | Switzerland | 145/3.5 |

*Primary Examiner*—Stephen G. Kunin
*Assistant Examiner*—J. T. Zatarga
*Attorney, Agent, or Firm*—Holman & Stern

[57] ABSTRACT

A hand-held pencil sharpener preferably of metal has opposed gripping surfaces formed with longitudinal ridges and recesses which are relatively wider than in conventional sharpeners to avoid their becoming clogged with dirt.

4 Claims, 8 Drawing Figures

PENCIL SHARPENER

This is a continuation of application Ser. No. 935,976 filed Aug. 22, 1978 now abandoned.

BACKGROUND OF THE INVENTION

This invention relates to a hand-held pencil sharpener preferably made of metal and having gripping surfaces which are provided with longitudinal grooves. As a rule, such gripping surfaces run approximately perpendicular to that surface of the pencil sharpener which is fitted with the cutting blade. The user grasps the sharpener with two fingers on the two mutually opposite gripping surfaces and turns the pencil, which is to be sharpened, with the other hand. It is a disadvantage of known pencil sharpeners that the longitudinal grooves of the gripping surfaces are generally very narrow, that is to say their depth and width is very small. Hence, after a certain period of use, these grooves or flutes can clog with dirt, in particular with the graphite or dyestuff arising on sharpening pencils. As a result, this adversely affects the grip and this dirt can be removed from the thin grooves or flutes only with difficulty. Consequently, dirt or graphite dust are as a rule never completely cleaned out of the grooves or flutes. Furthermore, the die which is used for making the pencil sharpener, wears in the course of time. Because of the smallness of the grooves or flutes, even slight wear of the parts of the die, which form the grooves or flutes at the later stage, entails a relatively large change on the latter, that is to say a noticeable reduction of the depth and width of the grooves. Moreover, wear of the die mould changes the shape and hence the appearance of the profile of the sharpener in an adverse manner. In addition, a change of the shape of the profile can have a disadvantageous effect in further working since the reference edges, required for this purpose, of the sharpener, are displaced if the die is altered by wear.

SUMMARY OF THE INVENTION

It is an object of the invention to avoid the dirt risk described and also the disadvantages which can result from wear of the die, using means which do not require any additional effort in production, whilst retaining a good grip of the sharpener.

To achieve this object, the invention proposes that each gripping surface has a maximum of four ridges extending in the longitudinal direction of the sharpener with recesses or grooves, located in between and extending in the longitudinal direction of the sharpener. As a result, both the ridges and the recesses have such a width that any dirt or graphite dust which may get in there, does not lodge but can easily be wiped off. Wear of the die will no longer have a noticeable effect on the strips and recesses which are, by comparison to known sharpeners, relatively wide. The grip, that is to say the ability to hold the sharpener securely and firmly with two fingers on these gripping surfaces, is substantially better than in the case of the known sharpeners, because of the size of the recesses between the individual strips.

Further advantages and features of the invention can be seen from the claims as well as the description which follows and the accompanying drawing of illustrative embodiments according to the invention.

DESCRIPTION OF PREFERRED EMBODIMENTS

Preferentially, the pencil sharpener consists of a body member of metal. For example, it is cut from extruded metal drawn through a die. It is provided with two opposite gripping surfaces 2 which extend at an approximately right angle to that surface of the sharpener which is provided with the cutting blade 3. The insertion opening for the pencil to be sharpened is numbered 4.

Figure 1:
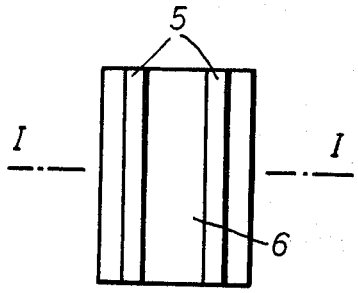
FIG. 1 shows a first illustrative embodiment of the invention in plan view.
Figure 1A:
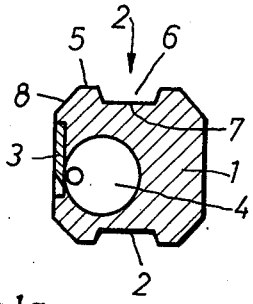
FIG. 1*a* shows a section along line I—I in FIG. 1.

In the illustrative embodiment of FIGS. 1 and 1*a*, each gripping surface 2 is provided with two ridges 5, between which there is a recess 6, the bottom surface 7 of which has a plane shape.

Figure 2:
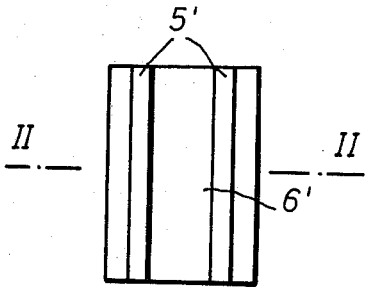
FIGS. 2, 2*a* to 4, 4*a* show further illustrative embodiments of the invention in plan view and in section, respectively.
Figure 2A:
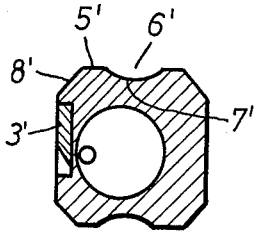

The illustrative embodiment of FIGS. 2 and 2*a* shows a similar design in which, however, the recess 6' has a concave bottom surface 7', which curves inwardly towards the opening 4. The ridges are here marked 5' and have a similar shape to the ridges 5 of the preceding illustrative embodiment, chamfers 8 to 8' extending from the strips towards the outsides.

Figure 3:
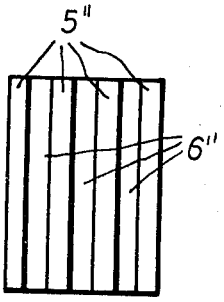
Figure 3A:
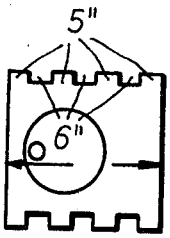

In the illustrative embodiment of FIGS. 3 and 3*a*, four ridges 5'' are provided across the width b of the gripping surface, three recesses 6'' with plane bottom surfaces being located between the ridges. Whereas in each of the preceding illustrative embodiments the recess was wider than the ridges, the example of FIGS. 3 and 3*a* shows a possible embodiment of the invention, in which the width of the ridges 5'' is approximately equal to the width of the recesses 6''.

Figure 4:
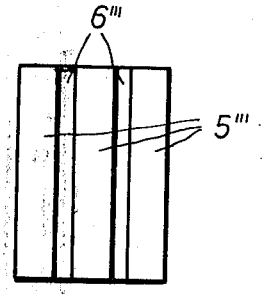
Figure 4A:
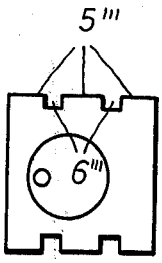

Finally, the illustrative embodiment of FIGS. 4 and 4*a* shows a further possible embodiment of the invention in which three ridges 5''' are provided, which in each case enclose a recess 6''' which by comparison is narrower than the ridges.

In each of the illustrative embodiments described, the disadvantages, which have been explained, of the dirt risk and of a noticeable change in the shape of the ridges and the recesses as a result of wear of the die are substantially avoided. The grip of the pencil sharpeners according to the above illustrative embodiments is good, in particular for the relatively small and clumsy hands of children.

What is claimed is:

1. A hand held pencil sharpener comprising a metallic body member of rectangular cross-section, said body member having a longitudinal pencil opening, sharpening means associated with said pencil opening and a pair of external gripping surfaces on opposite sides of said body member independent from said pencil opening and said sharpening means, each gripping surface comprising at least three longitudinal ridges having equal width, a longitudinal recess between each pair of adjacent ridges, each recess having a planar bottom surface, planar side walls and a substantially rectangular cross-section, and said recesses being equal in width.

2. The pencil sharpener of claim 1 wherein said ridges and recesses are substantially symmetrically distributed across the gripping surfaces and the width of each recess throughout its entire depth is equal to the width of each ridge.

3. The pencil sharpener of claim 1 or claim 2 wherein each gripping surface has a pair of opposed longitudinal edges and one of said ridges is provided along each longitudinal edge of the respective gripping surface.

4. The pencil sharpener of claim 2 wherein there are four longitudinal ridges.

* * * * *